United States Patent [19]

Anderson et al.

[11] 4,255,893

[45] Mar. 17, 1981

[54] FLYING SAUCER CAPABLE OF PERFORMING AERIAL ACROBATIC MANEUVERS

[76] Inventors: William E. Anderson, 21 Franklin St., Trenton, N.J. 08611; Richard C. Caran, 861 Revere Ave., Trenton, N.J. 08629

[21] Appl. No.: 115,873

[22] Filed: Jan. 28, 1980

[51] Int. Cl.[3] ..... A63H 27/00

[52] U.S. Cl. ..... 46/74 D; 273/424

[58] Field of Search ..... 46/74 D, 75; 273/424, 273/425, 428

[56] References Cited

U.S. PATENT DOCUMENTS

| | | | |
|---|---|---|---|
| 2,744,356 | 5/1956 | Killinger et al. | 273/424 X |
| 2,835,073 | 5/1958 | Dame | 46/74 D |
| 3,571,811 | 3/1971 | Wilson | 273/424 X |
| 3,738,053 | 6/1973 | Camarota | 46/74 D |
| 4,132,029 | 1/1979 | Thompson et al. | 46/74 D |

*Primary Examiner*—Robert Peshock
*Assistant Examiner*—Mickey Yu
*Attorney, Agent, or Firm*—Arthur L. Plevy

[57] ABSTRACT

There is disclosed a flying saucer device which basically has a flat top surface including symmetrically disposed apertures. A bottom section consists of a central cone shaped portion having a top surface containing additional apertures in a predetermined alignment with the apertures in the flat surface. A bottom section surrounds the central cone section and contains apertures which are aligned with the apertures in the top section. The apertures in the top and bottom sections communicate one with the other and with the apertures in the central cone section by means of an annular cavity which is formed when the top section is emplaced with the bottom section. The top and bottom sections are emplaced with respect to a relatively central sloping wing section to afford lift to the device and which surrounds and extends beyond the top and bottom sections of the flying saucer device. The device disclosed is capable of performing various acrobatic maneuvers with a major maneuver being the ability of the device to roll so that the top section is always furthest from the ground.

10 Claims, 5 Drawing Figures

Fig. 1
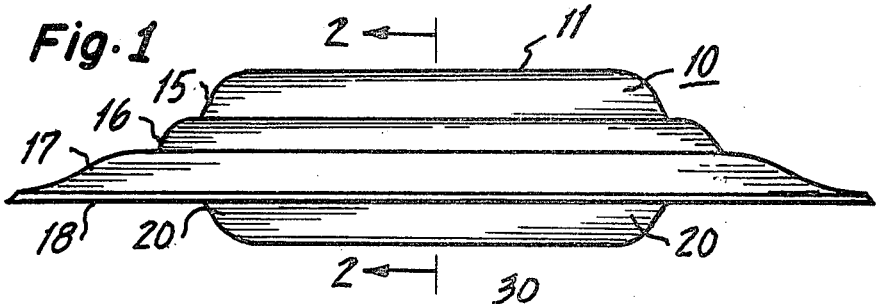
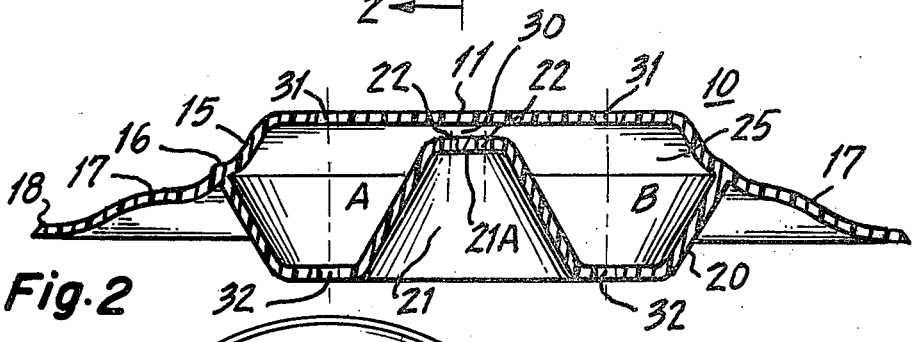
Fig. 2
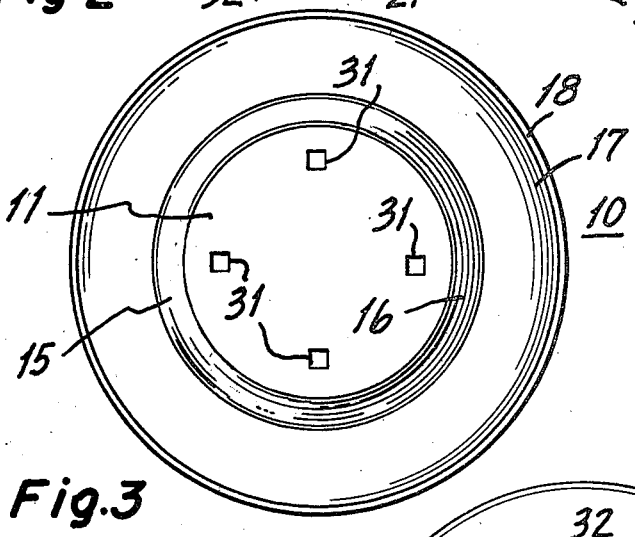
Fig. 3
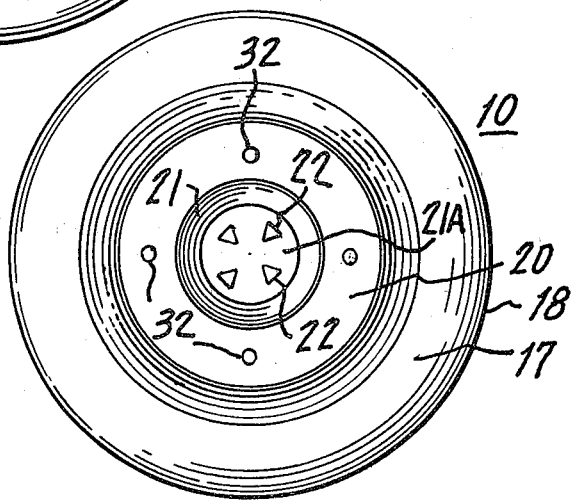
Fig. 4

FLYING SAUCER CAPABLE OF PERFORMING AERIAL ACROBATIC MANEUVERS

BACKGROUND OF THE INVENTION

This invention relates to aerodynamic toys and more particularly to a flying saucer apparatus adapted to perform aerial maneuvers when thrown into the air by a user.

Flying saucer type toys are extremely popular and many varieties and designs are available commerically and disclosed in the patent literature. Essentially, such devices differ in structure and in the maneuvers which the devices can perform when employed.

The patent art shows a number of patents which attempt to improve the design and operation of such devices by the addition or modification of structure. Probably, to date, the most successful of such devices have been marketed under the trademark FRISBEE and are depicted in U.S. Pat. Nos. 3,724,122 and 3,359,678. These devices essentially appear as circular disks having rounded top surfaces with various rib structures to improve aerodynamic performance.

In conjunction with improving such devices and for providing various other devices, many other patents exist as well. Essentially, certain patents such as U.S. Pat. No. 3,502,355 entitled Orbit and Soaring Skill Toy attempt to simulate a space vehicle as opposed to flying disk structures as above. Other patents as U.S. Pat. No. 3,742,643 entitled Flying Device consist of inner and outer rings which are joined together by a series of foils in an attempt to impart maneuverability to the toy. Other patents as U.S. Pat. No. 4,023,805 entitled Tricky Disk show various alternate surface configurations to impart desired flight characteristics to such a device.

Patents such as U.S. Pat. No. 3,852,910 entitled Aerial Toy depict a saucer device which has a series of adjustable air foils which enable one to compensate for various wind conditions and other factors which may effect the flight characteristics. Still other patents as U.S. Pat. No. 4,075,781 entitled Flying Disk and U.S. Pat. No. 4,132,029 entitled Pyramid Flyer show various surface configurations which purportedly enable flight control and generally seek to enhance the enjoyment of a user in playing with such a toy.

It is an object of the present invention to provide a flying saucer device which has an outward appearance manifesting a space vehicle. The configuration to be described is also capable of executing a wide variety of maneuvers.

A major aspect of the saucer to be described is that the device will roll, which essentially means that it will turn over to a top position and continue flight in a horizontal line. The extent of the roll is a function of the angle that the device is initially launched at or thrown at. In any event, the ability of the device to turn over or roll imparts unique flight characteristics and offers the user greater flexibility and pleasure in using such a device.

BRIEF DESCRIPTION OF THE PREFERRED EMBODIMENT

An aerodynamic flying saucer apparatus, comprising a top section comprising a relatively circular planar member having a flat top surface surrounded by a smooth downwardly extending flange, an outwardly extending wing section extending symmetrically about said flange of said top section, a bottom annular section extending downwardly from said wing section with a central cone shaped recessed region having a central top wall extending near said flat top surface, with said bottom and top section forming an annular cavity about said cone shaped region with said cavity having a reduced portion at the center due to said top wall of said cone shaped region in proximity with said flat top surface, said flat top surface having a plurality of apertures communicating with said cavity, with said bottom section having on a surface, a first plurality of apertures communicating with said cavity, and having on said central top wall, a second plurality of apertures, with said first apertures relatively aligned with said apertures in said flat top surface, to cause turbulence to be provided in said cavity when said saucer is thrown by a user, said turbulence due to said apertures in said top and bottom sections and said apertures in said central wall of said recess.

BRIEF DESCRIPTION OF THE FIGURES

FIG. 1 is a front plan view of a saucer according to this invention;

FIG. 2 is a cross sectional view taken through the center of FIG. 1;

FIG. 3 is a top view of the saucer depicted in FIG. 1;

FIG. 4 is a bottom view of the saucer; and

DETAILED DESCRIPTION OF THE INVENTION

Figure 5:
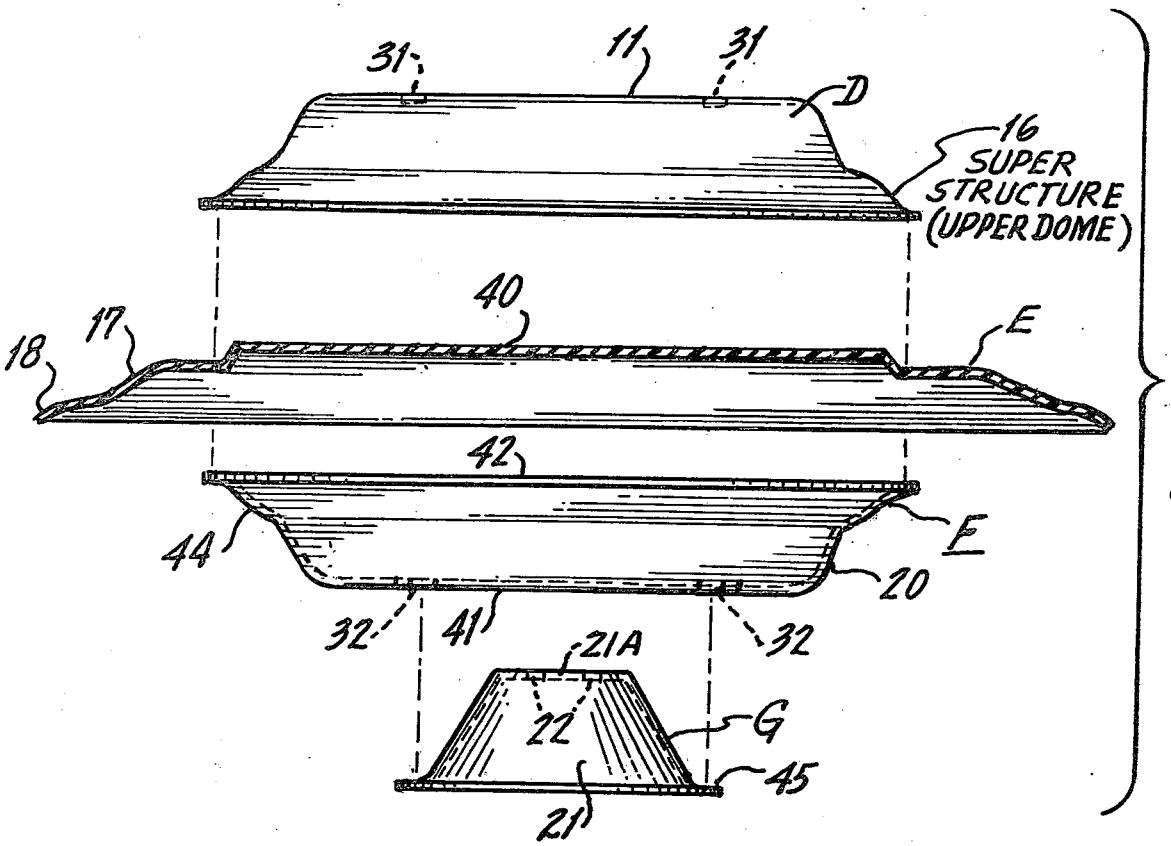
FIG. 5 is a plan view showing the major components necessary to fabricate a saucer as shown in FIG. 1.

Referring to FIG. 1, there is shown a front view of a flying saucer 10 according to this invention. Essentially, the saucer 10 may be fabricated from a plastic, a paper or some other relatively inexpensive material and of the type which prior art devices are fabricated from.

The saucer 10 has a flat top surface 11 which, as will be explained, has a series of apertures on the surface thereof. The top surface 11 tapers about the periphery via a smooth curved portion 15 into a median peripheral flange 16 which also possesses a smooth surface configuration. Relatively centrally located is a wing member 17 which is fabricated from a relatively thin material and is terminated by means of a peripheral rim or flange 18. The saucer 10 has a bottom annular structure shown in FIG. 1 as 20.

Essentially, as one can see from FIG. 1, the structure differs from many of the prior art devices in that it is a substantially three-dimensional structure having the appearance of a space vehicle similar to the types as displayed in movies, books and so on. As will be explained, the device depicted in FIG. 1, when tossed in the air, exhibits great maneuverability and can perform many aerobatic actions. In FIG. 1, the surface 11 indicates the top of the unit, while the bottom of the unit is designated about the surface 20.

Referring to FIG. 2, there is shown a cross-sectional view of the device depicted in FIG. 1. The same reference numerals have been retained to designate corresponding parts. The saucer is shown in a unitary configuration, but as will be explained, for production purposes or for practical purposes, the unit 10 may lend itself to fabrication by separate sections.

As can be seen from FIG. 2, the bottom surface 20 is manifested by a central truncated cone shaped area 21. The top surface 21A of the area 21 has a plurality of apertures 22 located therein. The unit 10 shown is characterized in that when the bottom section 20 is emplaced on the top section including surface 11, an annular cavity 25 is formed. The cavity 25, as indicated, is annular and consists of a right section A and a left section B which communicate with each other via the small space 30 provided by the top surface of the cone shaped depression 21 and the top surface 11 of the unit.

As will be explained, the top surface 11 has apertures 31 located thereon. The bottom surface 20 which surrounds the cone shaped central depression 21 possesses apertures as 32 which communicate with the apertures 31 via the cavity 25. In this manner, air can flow via apertures 32 through the cavity and out through apertures 31 or vice versa. Air flow can also be accommodated via the apertures 22 in the top surface 21A of the cone shaped central portion 21.

Referring to FIG. 3, there is shown a top view of the saucer 10. In FIG. 3, the same reference numerals have been emloyed again to denote equivalent parts. The apertures 31 are shown on the top surface 11 and basically are located at 90° intervals and comprise four apertures which are shown as rectangular or square in shape. In any event, it is understood that any other geometrical shape will suffice.

FIG. 4 depicts a bottom view of the saucer 10 where corresponding parts are again designated by the same reference numerals. As can be seen, the bottom surface 20 has four corresponding apertures 32 which are shown as circular apertures and which apertures align with the apertures 31 in the top surface.

The top surface 21A of the central cone shaped section 21 also has four apertures as 22 which are triangular in shape and are located between apertures 32 and hence, between apertures 31 on the top surface. The apertures as 22 are offset by 45° from the apertures 32 and as can be seen from the FIGURE.

Referring to FIG. 5, there is shown a plan view again employing the same reference numerals and indicating one way of forming the structure depicted. A top section D consists of a circular disk-like member having the flat top surface 11 with apertures as 31 spaced thereon as shown in FIG. 3. The top section D is integrally formed with the rim or curved protrusion 16 of FIG. 1.

The top section is emplaced on the wing section E which consists of the thin wing portion 17 terminated in the flange portion 18. The wing section 17 has a large central aperture 40 over which the section D is emplaced as shown and secured thereto by means of an epoxy or by a plastic weld or some other bond.

The bottom section 20 designated as F has a bottom aperture 41 and a large top opening 42. As can be seen from FIG. 5, the bottom section 20 essentially is of the same surface configuration as the top section D, with the exception of the aperture 41 in the bottom and with the holes as 32 positioned about the periphery of the aperture 41 and in communication with the holes 31 located on the top section D. Accordingly, the bottom section F also has a peripheral smooth flange 44 which is similar to flange 16 associated with the top section D. The bottom section F is emplaced beneath the wing section E as shown in FIG. 5 and is secured thereto adjacent to and beneath the top section D.

The central cone depression 21 is shown in FIG. 5 as section G. Essentially, it consists of a truncated cone of a top surface 21A with the triangular shaped or other apertures 22 located thereon. The bottom portion of the cone section 21 contains a peripheral flange 45 which abutts against the periphery of the aperture 41 and is secured thereto, again by means of an adhesive or a suitable plastic bond or weld.

Thus, as one can ascertain from FIG. 5, the unit shown in cross section in FIG. 2 consists of four parts, D,E,F and G which when assembled will create the unit depicted in FIGS. 1 and 2. It is, of course, understood that the apertures in the top, bottom and conical surfaces are aligned as depicted and described in conjunction with FIGS. 3 and 4.

The unit thus described offers a plurality of reactive forces based on the air flow afforded between the apertures in the top and bottom surfaces as coupled one to the other through the central annular cavity as 25 (A and B) of FIG. 2. The apertures in the top surface 21 of the conical member as offset from the other apertures, offers additional flow paths. Due to the location of the apertures, these flow paths create turbulence or fluctuating pressures in the annular chamber 25. The pressures afford extra lift to the wing section E, while the location of the additional apertures on the bottom surface as including both apertures 32 and apertures 22, enable the craft to turn or roll. In this manner, if a user grasps the wing section 17 of the saucer 10 and throws it with the bottom member 20 facing upward, the craft 10 will roll and right itself and thereafter fly relatively horizontally with the top surface 11 facing upwardly. By controlling the angle of the toss and the speed of the throw, a user can execute various acrobatic maneuvers which incorporate the roll as described.

Thus, the device 10 exhibits a corkscrew roll which will terminate when the surface 11 is in the horizontal plane and the saucer will then continue a horizontal flight in the upright position. The saucer depicted can execute other flight patterns as S shaped, U shaped and so on; all of which may be associated with the roll if the device is thrown with the bottom surface facing upward. In any event, if one launches the device with the top surface 11 facing up, then the saucer 10 will fly relatively horizontal.

While dimensions are not important, the unit shown is approximately twelve inches in diameter and approximately two inches in height from top to bottom surface. It is, of course, understood that other dimensions can be accommodated without departing from the operation of the above described device.

From the above description, it will be clear that the novelty of this device resides in the formation of the inner chamber 25 which enables communication between the top and bottom surfaces of the unit via the apertures 31 and 32. A central cone shaped portion including the apertures 22 on the top surface offers additional turbulence within the chamber to enable the resultant device to upright itself or roll over when thrown with the top surface facing the ground or with the bottom surface in an up position.

Thus, the device described above offers great advantages in regard to appearance and in regard to its ability in performing acrobatic maneuvers, which advantages do not exist in similar devices depicted and shown in the prior art. It is apparent that various other maneuvers may be performed by this device depending upon the skill or ability of the user. In any event, it is a main feature of this apparatus to perform a roll when thrown or launched as described and this operation and structure is deemed to be unique.

While it is understood that the device could be made as an integral unit by a suitable plastic molding technique, it is preferable that the device be constructed as depicted in FIG. 5 to thereby enable one to produce relatively simple parts by using simple and economical apparatus.

Various alternate embodiments of the present invention will be discerned by those skilled in the art upon reading the above specification in conjunction with the appended figures and all such modifications and descriptions are deemed to be encompassed within the spirit and scope of the claims appended hereto.

We claim:

1. An aerodynamic flying saucer apparatus, comprising:

a top section comprising a relatively circular planar member having a flat top surface surrounded by a smooth downwardly extending flange, an outwardly extending wing section extending symmetrically about said flange of said top section, a bottom annular section extending downwardly from said wing section with a central cone shaped recessed region having a central top wall extending near said flat top surface, with said bottom and top sections forming an annular cavity about said cone shaped region with said cavity having a reduced portion at the center due to said central top wall of said cone shaped recessed region in proximity with said flat top surface, said flat top surface having a plurality of apertures communicating with said cavity, with said bottom section having on a surface, a first plurality of apertures communicating with said cavity and having on said central top wall, a second plurality of apertures, with said first apertures relatively aligned with said apertures in said flat top surface, to cause turbulence to be provided in said cavity when said saucer is thrown by a user, said turbulence due to said apertures in said top and bottom sections and said apertures in said central top wall of said cone shaped recess region.

2. The apparatus according to claim 1 wherein said apertures in said top surface are at least four, arranged in a circular pattern separated ninety degrees one from the other.

3. The apparatus according to claim 2 wherein said first plurality of apertures in said bottom surface are at least four and are aligned with said apertures in said top surface.

4. The apparatus according to claim 3 wherein said second plurality of apertures in said central top wall are at least four and are positioned between said first plurality of apertures.

5. The apparatus according to claim 1 wherein said turbulence is operative to cause said saucer apparatus to turn upright when the same is thrown with said top section facing the ground, whereby said saucer rolls to cause said bottom section to face the ground.

6. The apparatus according to claim 1 wherein said top, bottom and wing sections are separate sections secured together.

7. The apparatus according to claim 1 wherein said flying saucer apparatus is fabricated from a plastic.

8. The apparatus according to claim 1 wherein said apertures in said top section are rectangular in shape.

9. The apparatus according to claim 1 wherein said first plurality of apertures are circular in shape.

10. The apparatus according to claim 1 wherein said second plurality of apertures are triangular in shape.

* * * * *